US010362377B2

(12) United States Patent
Liao et al.

(10) Patent No.: US 10,362,377 B2
(45) Date of Patent: Jul. 23, 2019

(54) MEMS MICROPHONE PACKAGE

(71) Applicant: LINGSEN PRECISION INDUSTRIES, LTD., Taichung (TW)

(72) Inventors: Hsien-Ken Liao, Taichung (TW); Ming-Te Tu, Taichung (TW); Jyong-Yue Tian, Taichung (TW); Yao-Ting Yeh, Taichung (TW)

(73) Assignee: LINGSEN PRECISION INDUSTRIES, LTD., Taichung (TW)

( * ) Notice: Subject to any disclaimer, the term of this patent is extended or adjusted under 35 U.S.C. 154(b) by 7 days.

(21) Appl. No.: 15/334,655

(22) Filed: Oct. 26, 2016

(65) Prior Publication Data

US 2018/0063615 A1 Mar. 1, 2018

(30) Foreign Application Priority Data

Aug. 24, 2016 (TW) ..... 105127064 A

(51) Int. Cl.

| | |
|---|---|
| ***H04R 1/04*** | (2006.01) |
| ***H04R 19/00*** | (2006.01) |
| ***H04R 19/04*** | (2006.01) |
| *H04R 31/00* | (2006.01) |

(52) U.S. Cl.

CPC ..... *H04R 1/04* (2013.01); *H04R 19/005* (2013.01); *H04R 19/04* (2013.01); *H04R 31/006* (2013.01); *H04R 2201/003* (2013.01)

(58) Field of Classification Search

CPC ..... H04R 1/04; H04R 19/04; H04R 19/005; H04R 2201/003

See application file for complete search history.

(56) References Cited

U.S. PATENT DOCUMENTS

| | | | | |
|---|---|---|---|---|
| 8,171,800 | B1 * | 5/2012 | Chiou | G01L 9/0052 73/716 |
| 2007/0058826 | A1 * | 3/2007 | Sawamoto | H04R 19/04 381/174 |
| 2008/0164888 | A1 * | 7/2008 | Suzuki | B81B 7/0064 324/686 |
| 2010/0177922 | A1 * | 7/2010 | Park | H04R 19/04 381/355 |
| 2014/0370855 | A1 * | 12/2014 | Koss | H04M 3/53366 455/413 |
| 2015/0091108 | A1 * | 4/2015 | Huang | B81B 7/0058 257/417 |
| 2017/0013355 | A1 * | 1/2017 | Kim | H04R 1/406 |

* cited by examiner

*Primary Examiner* — Charles D Garber
*Assistant Examiner* — S M Sohel Imtiaz
(74) *Attorney, Agent, or Firm* — Muncy, Geissler, Olds & Lowe, P.C.

(57) ABSTRACT

A MEMS microphone package includes a substrate including a sound hole, a first conduction part and a second conduction part, a sidewall connected with one end thereof to the substrate and having a conducting line electrically connected to the second conduction part, a cover plate connected to an opposite end of the sidewall and defining a chamber therein and having a solder pad and a fifth contact in conduction with the solder pad and electrically connected to the conducting line, a processor chip mounted on the substrate inside the chamber and electrically connected to the first conduction part and the second conduction part, and a acoustic wave sensor mounted on the substrate inside the chamber to face toward the sound hole and electrically connected to the first conduction part using flip-chip technology.

18 Claims, 2 Drawing Sheets

MEMS MICROPHONE PACKAGE

BACKGROUND OF THE INVENTION

1. Field of the Invention

The present invention relates to semiconductor packaging technology and more particularly, to a MEMS (micro-electromechanical system) microphone package.

2. Description of the Related Art

MEMS is a technology that in its most general form can be defined as miniaturized mechanical and electro-mechanical elements (i.e., devices and structures) that are made using the techniques of micro fabrication. When compared with conventional electrets condenser microphones (ECM), MEMS microphones have the advantages of small package size, low power consumption and better environmental interference (such as temperature variation and electromagnetic interference) suppression ability. Therefore, the application of MEMS microphones in the field of acoustics will be more and more widespread.

In a conventional MEMS microphone 90, as illustrated in FIG. 4, the acoustic wave sensor 91 and the ASIC (Application-specific Integrated Circuit) 92 are electrically connected to the substrate 93 using wire bonding technology. Thus, the sidewall 94 that is mounted at the substrate 93 needs to provide a spare height H for accommodating the metal wire 95 so that the cover plate 96 can be connected to the sidewall 94 to complete the packaging process. However, since MEMS microphones have been widely used in smart phones, wire bonding is obviously inconsistent with the current market trend of low profile packaging. Further, wire bonding has the drawbacks of more signal interference and low I/O pin count.

Therefore, it is desirable to provide a MEMS microphone that eliminates the drawbacks of the aforesaid prior art MEMS microphone design.

SUMMARY OF THE INVENTION

The present invention has been accomplished under the circumstances in view. It is the main object of the present invention to provide a MEMS microphone package, which has the advantages of low profile packaging and low signal interference.

To achieve this and other objects of the present invention, a MEMS microphone package comprises a substrate, a sidewall, a cover plate, a processor chip and an acoustic wave sensor. The substrate comprises a sound hole, a first conduction part and a second conduction part. The sidewall is connected with one end thereof to the substrate, comprising a conducting line electrically connected to the second conduction part. The cover plate is connected to an opposite end of the sidewall, defining with the sidewall and the substrate a chamber therein. Further, the cover plate comprises a solder pad, and a fifth contact disposed in conduction with the solder pad and electrically connected to the conducting line. The processor chip is mounted on the substrate and electrically connected with the first conduction part and the second conduction part. Further, the processor chip is disposed in the chamber. The acoustic wave sensor is mounted on the substrate, and electrically connected with the first conduction part using flip-chip technology. Further, the acoustic wave sensor is disposed in the chamber to face toward the sound hole.

Thus, because the acoustic wave sensor is electrically connected with the first conduction part of the substrate using flip-chip technology, the sidewall and the chamber do not need to provide a spare height for accommodating wire bonding metal wires, and therefore, the invention overcomes the problem of the prior art design that is unable to provide a low profile characteristic due to the application of wire bonding technology to electrically connect the acoustic wave sensor to the substrate. When compared to conventional wire bonding technology, the invention using flip-chip technology to electrically connect the acoustic wave sensor to the substrate has the advantages of better heat dissipation, lower signal interference and high I/O pin count.

Other advantages and features of the present invention will be fully understood by reference to the following specification in junction with the accompanying drawings, in which like reference signs denote like components of structure.

DETAILED DESCRIPTION OF THE INVENTION

Figure 1:
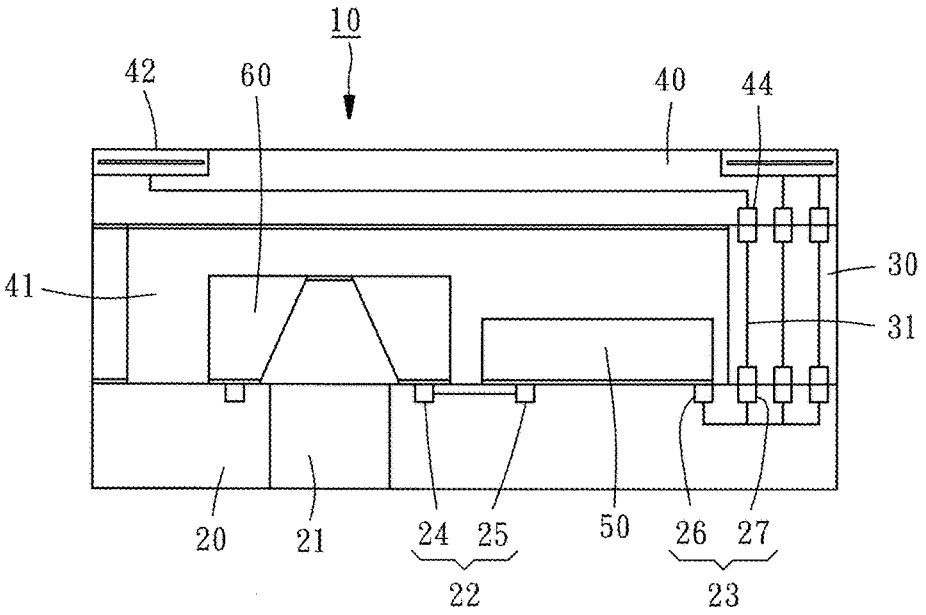
FIG. 1 is a sectional view of a MEMS microphone package in accordance with the present invention.

Referring to FIG. 1, a MEMS (micro-electromechanical system) microphone package 10 in accordance with the present invention is shown. The MEMS microphone package 10 comprises a substrate 20, a sidewall 30, a cover plate 40, a processor chip 50 and an acoustic wave sensor 60.

The substrate 20 comprises a sound hole 21, a first conduction part 22 and a second conduction part 23. The sound hole 21 is adapted for the passing of acoustic waves. The first conduction part 22 comprises a first contact 24 and a second contact 25. The first contact 24 and the second contact 25 are electrically conducted. The second conduction part 23 comprises a third contact 26 and a fourth contact 27. The third contact 26 and the fourth contact 27 are electrically conducted.

The sidewall 30 has one end thereof mounted at the substrate 20, more specifically, the sidewall 30 extends around the border of the substrate 20. Further, the sidewall 30 comprises a conducting line 31 electrically connected to the fourth contact 27.

The cover plate 40 can be a metal substrate, fiberglass substrate or ceramic substrate. The cover plate 40 is connected to an opposite end of the sidewall 30, defining a chamber 41 that is surrounded by the cover plate 40, the sidewall 30 and the substrate 20. Further, the cover plate 40 comprises at least one solder pad 42 and a fifth contact 44. The at least one solder pad 42 are electrically conducted with the fifth contact 44. The fifth contact 44 is electrically connected to the conducting line 31 of the sidewall 30. The quantity of the at least one solder pad 42 in other embodiments can be plurality.

In other embodiments, the quantity of the fourth contact 27, the fifth contact 44 and the conducting line 31 can be the same plurality and respectively electrically connected, for example, three conducting lines 31 are respectively electrically connected to respective three fourth contacts 27 and respective three fifth contacts 44.

The processor chip 50 is mounted on the substrate 20 and electrically connected with the first conduction part 22 and the second conduction part 23, more specifically, the processor chip 50 is electrically connected with the second contact 25 of the first conduction part 22 and the third contact 26 of the second conduction part 23 using flip-chip technology. Further, the processor chip 50 is disposed in the chamber 41. In the present preferred embodiment, the processor chip 50 is an application-specific integrated circuit (ASIC) designed and manufactured according to specific user needs for use in specific electronic systems. The processor chip 50 can have a charge pump, a voltage regulator, an amplifier, a sigma delta modulator and a digital-to-analog converter integrated therein, providing small size, improved performance and noise suppression characteristics.

Figure 3:
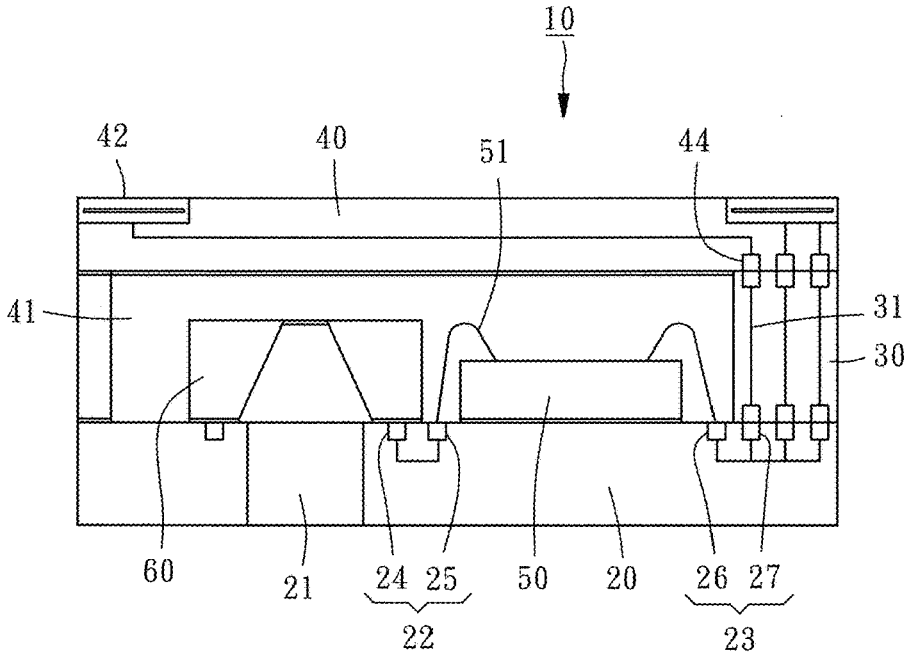
FIG. 3 is a sectional view of an alternate form of the MEMS microphone package in accordance with the present invention, illustrating the processor chip wire bonded to the first conduction part and second conduction part of the substrate.
Figure 4:
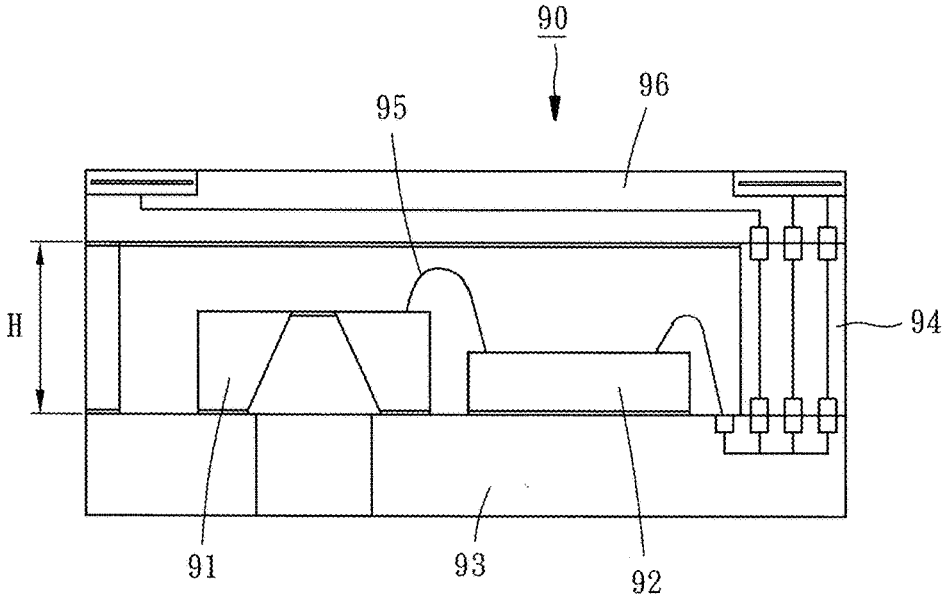
FIG. 4 is a sectional view of a MEMS microphone according to the prior art.

Referring to FIG. 3, in an alternate form of the present invention, the processor chip 50 is installed using wire bonding technology, and electrically connected with the second contact 25 of the first conduction part 22 and the third contact 26 of the second conduction part 23 through at least one metal wire 51.

The acoustic wave sensor 60 is mounted on the substrate 20, and electrically connected with the first conduction part 22, more specifically, the acoustic wave sensor 60 is electrically connected with the first contact 24 of the first conduction part 22 using flip-chip technology. The acoustic wave sensor 60 is disposed in the chamber 41 to face toward the sound hole 21 for receiving external acoustic wave signals. In this embodiment, the acoustic wave sensor 60 is capable of converting an external acoustic wave signal to an electrical signal for transmission through the first conduction part 22 to the processor chip 50 for further processing.

In other embodiments, multiple processor chips 50 can be stacked up on the substrate 20, enabling the MEMS microphone package 10 to provide multiple functions; however, the overall height of the stack of processor chips 50 should not be greater than the height of the acoustic wave sensor 60.

Figure 2:
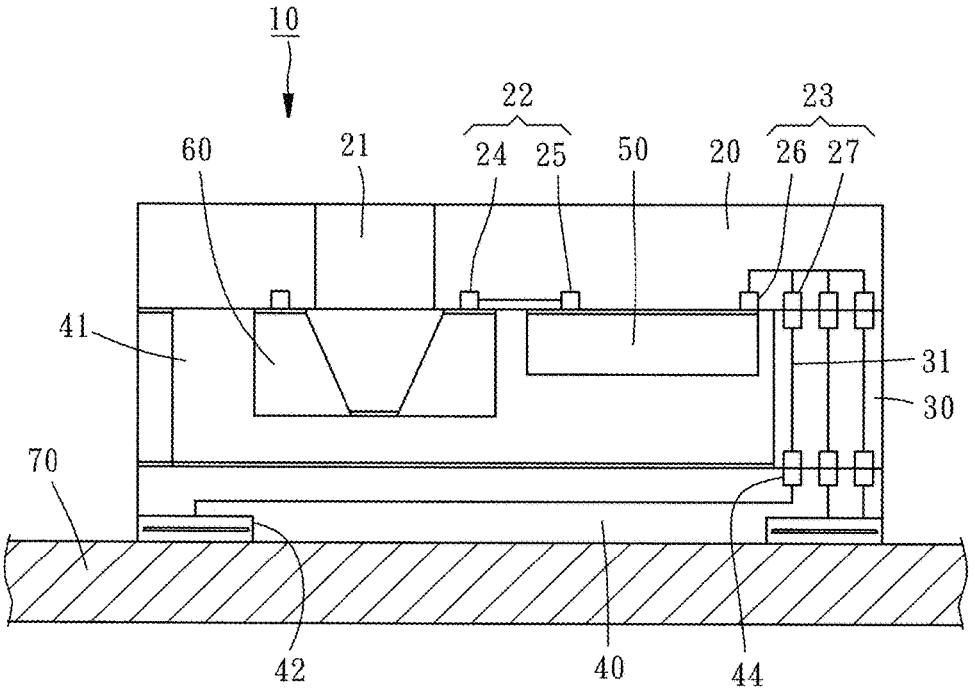
FIG. 2 is a sectional applied view of the present invention, illustrating the MEMS microphone package electrically coupled to an external circuit.

Referring to FIG. 2 again, in application of the MEMS microphone package 10, the MEMS microphone package 10 shown in FIG. 1 is turned upside down to keep the cover plate 40 facing down and the substrate 20 facing up. The acoustic wave sensor 60 can receive an external acoustic wave signal through the sound hole 21, and converts the received acoustic wave signal to an electrical signal. The first conduction part 22 transmits the electrical signal from the acoustic wave sensor 60 to the processor chip 50 for processing. After the processing process, the processor chip 50 transmits the processed signal properly through the second conduction part 23, the conducting line 31 and the fifth contact 44 to the at least one solder pad 42 for use by an external circuit 70.

In conclusion, the acoustic wave sensor 60 is electrically connected with the first conduction part 2 of the substrate 20 using flip-chip technology, thus, the sidewall 30 and the chamber 41 do not need to provide a spare height for accommodating wire bonding metal wires; the MEMS microphone package 10 of the present invention has a low-profile characteristic; when compared to conventional wire bonding technology, flip-chip technology has the advantages of better heat dissipation, lower signal interference and high I/O pin count.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A MEMS microphone package, comprising:

a substrate comprising a sound hole, a first conduction part and a second conduction part;

a sidewall having a first top end, and a first bottom end fixedly connected to said substrate, said sidewall comprising a conducting line having a second top end, and a second bottom end electrically connected to said second conduction part;

a cover plate connected to the first top end of said sidewall and defining with said substrate, said sidewall and said cover plate a chamber therein, said cover plate comprising at least one solder pad and a fifth contact electrically conducted with said at least one solder pad, said fifth contact being electrically connected to the second top end of said conducting line;

a processor chip mounted on said substrate and electrically connected to said first conduction part and said second conduction part, said processor chip being disposed in said chamber; and an acoustic wave sensor mounted on said substrate and electrically connected to said first conduction part using flip-chip technology, said acoustic wave sensor being disposed in said chamber to face toward said sound hole;

wherein said conducting line is embedded in an interior of said sidewall in a way that the second top end and the second bottom end of said conducting line are exposed at the first top end and the first bottom end of said sidewall, respectively.

2. The MEMS microphone package as claimed in claim 1, wherein said first conduction part comprises a first contact and a second contact in conduction with said first contact; said second conduction part comprises a third contact; said processor chip is electrically connected with said second contact and said third contact; said acoustic wave sensor is electrically connected with said first contact.

3. The MEMS microphone package as claimed in claim 2, wherein said second conduction part further comprises a fourth contact in conduction with said third contact; said conducting line of said sidewall is electrically connected with said fourth contact.

4. The MEMS microphone package as claimed in claim 1, wherein said processor chip is electrically connected with said first conduction part and said second conduction part using flip-chip technology or wire bonding technology.

5. The MEMS microphone package as claimed in claim 2, wherein said processor chip is electrically connected with said second contact and said third contact using flip-chip technology or wire bonding technology.

6. The MEMS microphone package as claimed in claim 3, wherein said processor chip is electrically connected with said second contact and said third contact using flip-chip technology or wire bonding technology.

7. The MEMS microphone package as claimed in claim 1, wherein said cover plate is selectively made of a metal substrate, fiberglass substrate or ceramic substrate.

8. The MEMS microphone package as claimed in claim 2, wherein said cover plate is selectively made of a metal substrate, fiberglass substrate or ceramic substrate.

9. The MEMS microphone package as claimed in claim 3, wherein said cover plate is selectively made of a metal substrate, fiberglass substrate or ceramic substrate.

10. The MEMS microphone package as claimed in claim 4, wherein said cover plate is selectively made of a metal substrate, fiberglass substrate or ceramic substrate.

11. The MEMS microphone package as claimed in claim 5, wherein said cover plate is selectively made of a metal substrate, fiberglass substrate or ceramic substrate.

12. The MEMS microphone package as claimed in claim 6, wherein said cover plate is selectively made of a metal substrate, fiberglass substrate or ceramic substrate.

13. The MEMS microphone package as claimed in claim 1, wherein said processor chip is an application-specific integrated circuit (ASIC).

14. The MEMS microphone package as claimed in claim 3, wherein said processor chip is an application-specific integrated circuit (ASIC).

15. The MEMS microphone package as claimed in claim 4, wherein said processor chip is an application-specific integrated circuit (ASIC).

16. The MEMS microphone package as claimed in claim 6, wherein said processor chip is an application-specific integrated circuit (ASIC).

17. The MEMS microphone package as claimed in claim 10, wherein said processor chip is an application-specific integrated circuit (ASIC).

18. The MEMS microphone package as claimed in claim 12, wherein said processor chip is an application-specific integrated circuit (ASIC).

* * * * *